US005727360A

United States Patent [19]

Focke

[11] Patent Number: 5,727,360

[45] **Date of Patent: *Mar. 17, 1998**

[54] APPARATUS FOR PRODUCING CIGARETTE PACKS

[75] Inventor: Heinz Focke, Verden, Germany

[73] Assignee: Focke & Co. (GmbH & Co.), Verden, Germany

[ * ] Notice: The term of this patent shall not extend beyond the expiration date of Pat. No. 5,544,467.

[21] Appl. No.: 665,098

[22] Filed: Jun. 14, 1996

Related U.S. Application Data

[63] Continuation of Ser. No. 179,565, Jan. 10, 1994, Pat. No. 5,544,467.

[30] Foreign Application Priority Data

Jan. 8, 1993 [DE] Germany ..... 43 00 149.1

[51] Int. Cl.[6] ..... B65B 7/00; B65B 11/28

[52] U.S. Cl. ..... 53/387.2; 53/234

[58] Field of Search ..... 53/234, 225, 387.2

[56] References Cited

U.S. PATENT DOCUMENTS

| | | | |
|---|---|---|---|
| 4,127,978 | 12/1978 | Lucke . | |
| 4,840,007 | 6/1989 | Focke et al. | 52/234 X |
| 4,999,970 | 3/1991 | Bamrungbhuet et al. | 53/234 X |
| 5,129,209 | 7/1992 | Focke | 53/234 X |
| 5,477,661 | 12/1995 | Draghetti et al. | 53/234 X |
| 5,544,467 | 8/1996 | Focke | 53/234 X |

FOREIGN PATENT DOCUMENTS

| | | |
|---|---|---|
| 317805 | 5/1989 | European Pat. Off. . |
| 370213 | 5/1990 | European Pat. Off. . |
| 418687 | 3/1991 | European Pat. Off. . |
| 338600 | 6/1918 | Germany . |
| 1511530 | 8/1969 | Germany . |
| 96203 | 3/1973 | Germany . |
| 2915680 | 10/1979 | Germany . |
| 3340763 | 5/1984 | Germany . |
| 8326510 | 9/1984 | Germany . |
| 3605177 | 8/1987 | Germany . |
| 3613482 | 10/1987 | Germany . |
| 3742791 | 7/1988 | Germany . |
| 3803377 | 10/1988 | Germany . |
| 3713332 | 1/1989 | Germany . |
| 3736403 | 5/1989 | Germany . |
| 3915888 | 1/1990 | Germany . |
| 4042179 | 7/1991 | Germany . |
| 4125098 | 2/1992 | Germany . |
| 4141013 | 6/1992 | Germany . |
| 52-15030 | 4/1977 | Japan . |
| 54-117290 | 9/1979 | Japan . |
| 3967743 | 1/1966 | Switzerland . |
| 1724009 | 4/1987 | U.S.S.R. . |
| 1036929 | 7/1966 | United Kingdom . |
| 2220187 | 1/1990 | United Kingdom . |

*Primary Examiner*—Linda Johnson
*Attorney, Agent, or Firm*—Sughrue, Mion, Zinn, Macpeak & Seas, PLLC

[57] ABSTRACT

Cigarette packs (20), having glued joints, are passed through a drying turret (23) over a relatively long period of time. In order to transfer the packs (20) from a preceding, transfer turret (22) to the drying turret (23), pockets (25, 26) of the two turrets are especially designed such that the pocket walls (30, 31, 32, 33) can be moved past one another to thereby transfer the packs (20), without radial displacement, from one pocket (25) to the other pocket (26). The packs (20) transferred from the drying turret (23) pass into elongate pack shafts (62) in which the packs (20), during revolution, are gradually displaced and out of which they finally emerge via an outlet opening (66) to be transferred to a removal conveyor (24).

17 Claims, 9 Drawing Sheets

IX
X
X
32/33
48
26
20
46
48
93
85
65
93
79
20
63
64
23
73
62
67
56
73
78
70
66
54
29
37
35
39/40
42
41
43
56
36
34
57
29
86
60
59
58
61
74
76
75
77

APPARATUS FOR PRODUCING CIGARETTE PACKS

This is a continuation of Application Ser. No. 08/179,565 filed Jan. 10, 1994 now U.S. Pat. No. 5,544,467.

BACKGROUND OF THE INVENTION

The invention relates to an apparatus for producing packs, in particular cuboidal cigarette packs, which, during manufacture, can be conveyed in receiving means or pockets of endless conveyors, in particular of revolving turrets, and can be transferred from one turret to a neighbouring turret, the pockets for the packs having movable pocket walls in order to hold the packs.

The efficiency of packaging machines, in particular for cigarette packs, is restricted if significant regions of the packaging machine are set up for cyclic operation. The trend is therefore increasingly towards setting up a packaging machine for continuous operation.

A problem, with this arrangement, is the handling of the packs, which have been completed in whole or in part, in the context of endless conveyers, in particular in the context of (folding or drying) turrets, if these revolve continuously. A turret belonging to the standard equipment of a packaging machine is provided along the circumference with receiving means or pockets for the packs. The friction-free transfer of the packs from one turret to the neighbouring turret is difficult since, in this arrangement, the packs have to be released by the one turret and received by the other turret.

SUMMARY OF THE INVENTION

The object of the invention is to propose measures for handling, in particular, cigarette packs in the context of a packaging machine, with the result that the most significant regions can be travelled over continuously, in particular the transfer of packs from one turret or the like to a neighbouring turret or the like.

In order to achieve this object, the apparatus according to the invention is characterized in that the pockets of neighbouring, axis-parallel turrets interengage in the region of a transfer section for the packs and the pocket walls are moved between open position and closed position such that the packs are released by the pockets of the one turret and are received by those of the other turret.

The neighbouring turrets (or other endless conveyors) are arranged at such a distance from one another that, in the region of the transfer section, the pockets with the packs meet precisely and, for a short time, revolve along a common movement path. This makes it possible to transfer the packs, without radially directed relative movement, from the pocket of one turret to the associated pocket of another turret.

For this purpose, it is necessary that, according to the invention, the pockets or the pocket walls thereof are designed such that they can be moved past one another. Furthermore, control of the movable, in particular pivotable, pocket walls is necessary, with the result that the packs are released by the one pocket and are received by the other pocket. In accordance with one proposal of the invention, the pocket walls are designed with corresponding cutouts, in particular are designed in a comb-like manner, with the result that the pockets can be moved past one another without disruption.

The turret receiving the packs is used to stabilize the rectangular or cuboidal shape of the packs and to harden glued joints. For this purpose, according to the invention, the packs are held, during a plurality of revolutions of the turret designed as drying turret, in shaping receiving means, in particular in pack shafts.

Further features of the invention relate to the packs being received from the drying turret and continuous further-conveying to a removal conveyor.

An exemplary embodiment of the apparatus according to the invention is illustrated in more detail hereinbelow with reference to the drawings, in which:

DESCRIPTION OF A PREFERRED EMBODIMENT

Figure 1:
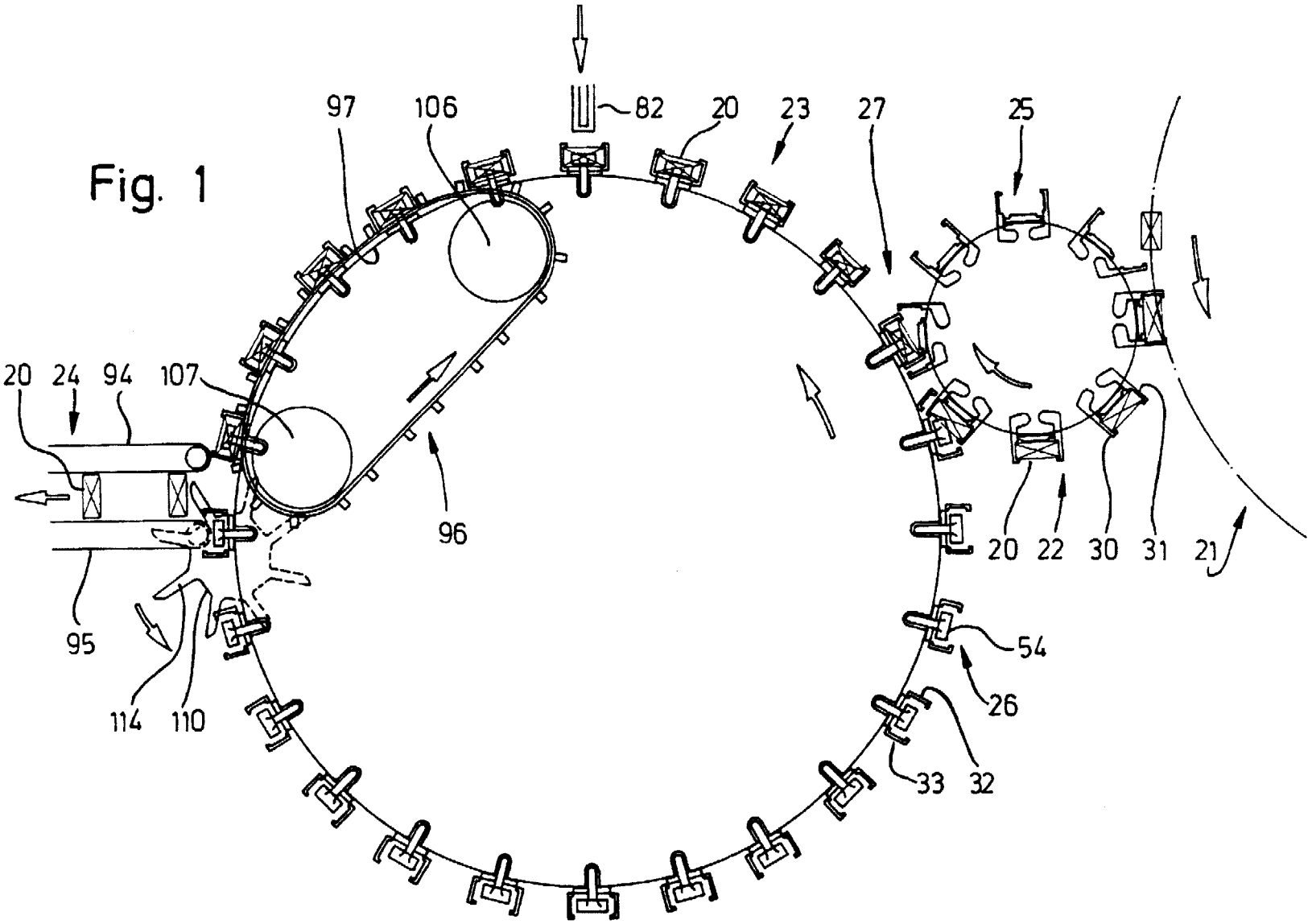
FIG. 1 shows neighbouring turrets of a packaging machine in schematic side view.

The examples represented in the drawings relate to the handling, that is to say the conveying, of cuboidal packs 20. These are cigarette packs, to be precise, in particular, soft packs. A packaging line for this type of pack 20 comprises a plurality of packaging regions. FIG. 1 shows, schematically, a continuously revolving folding turret 21. This is used for completion of the pack 20. From the folding turret 21, the packs are given away to an intermediate turret or transfer turret 22. This feeds the packs 20 to a further turret, that is to say a drying turret 23. This is set up to receive the finished packs 20 over a relatively long period of time in order that the glued joints of the packs 20 can set and the exact format of the packs 20 is thus stabilized.

The packs emerging from the drying turret 23 are transferred to a removal conveyer 24.

The transfer of the packs from a continuously revolving turret (transfer turret 22) to the next, likewise continuously revolving turret (drying turret 23) is carried out in a particular manner. The two turrets are equipped with pockets 25, 26 which are designed in a particular manner and are intended for receiving the packs 20 temporarily. In each case a plurality of pockets 25, 26 are arranged at the same, coordinated spacings on the circumference of the transfer turret 22 and of the drying turret 23. The spacings of these axis-parallel turrets from one another are selected such that, in a transfer region 27, the movement paths of the pockets 25 and 26 make contact with one another or merge into one another in such a manner that the pockets of the neighbouring turrets temporarily overlap by means of their cross-section. In said transfer region 27, the packs 20 of the respective pocket 25 of the transfer turret 22 are transferred to an associated pocket 26 of the drying turret 23.

The pockets 25 and 26 have a fixed pocket base 28 and 29, respectively. The pack rests thereon temporarily. Furthermore, each pocket 25, 26 is provided with two lateral pocket walls 30, 31 and 32, 33, respectively. The respectively mutually opposite pocket walls 30 . . . 33 can move, that is to say they can pivot. These are designed as a two-armed lever and are respectively rotatably mounted in pivot bearings 34, 35. A shaft journal 37 which is fitted laterally on a continuation 36 of the pocket wall 30 . . . 33 can rotate. In the case of the present exemplary embodiment, the shaft journal 37, and thus the pocket wall 30 . . . 33, is actuated via a lever 38 on the free end of which there is arranged a feeler roller 39, 40. The two feeler rollers run on associated paths 41, 42 of a cam plate 43. The paths 41, 42 and, correspondingly, the feeler rollers 39, 40 of the two pocket walls 32, 33 are arranged offset with respect to one another.

The pockets 25 of the transfer turret 22 are designed in an analogous manner as described above. The same also applies for the mounting and actuation of the pocket walls 30, 31. The actuating members which have been described are located inside or outside depressions 44 in the transfer turret 22 or in the drying turret 23.

A further special feature of the pockets 25, 26 is that the latter, owing to their shaping, interengage in a sub-region, that is to say in the transfer region 27. The relative positions are selected such that the free cross-sections of mutually assigned pockets 25, 26 coincide with one another in the transfer region 27 for a short period of time. A pack 20 fed from the pocket 25 thus passes, without transverse or radial movement, into the pocket 26 of the drying turret 23.

The illustrated relative position of the pockets 25, 26 of neighbouring turrets is made possible in that the pocket walls 30, 31, on the one hand, and 32, 33, on the other hand, have protrusions and cutouts which correspond with one another. As can be seen, in particular, from FIG. 3, the pocket walls 30 . . . 33 of the exemplary embodiment shown are designed in a comb-like manner. Each pocket wall 30 . . . 33 comprises tooth-shaped protrusions or elevations 45 or 46 and cutouts 47, 48 located therebetween. The cutouts 48 of the pocket walls 32, 33 of the pockets 25 are arranged and dimensioned such that, in the transfer region 27, the protrusions 45 of the pocket walls 30, 31 pass into said cutouts 48, and are moved through them, with a small amount of play. The cutouts 47 and the protrusions 46 passing through these are arranged and dimensioned analogously. The actual pocket walls 30 . . . 33 are formed, in this arrangement, by the protrusions 45, on the one hand, and 46, on the other hand. The cutouts and protrusions of the pocket walls 30, 31 on the one hand, and of the pocket walls 32, 33, on the other hand, are arranged offset with respect to one another.

At least some protrusions 45, 46 are dimensioned, in terms of their length or height, such that they project, on the radially outwardly located side, beyond the pack 20 located in the pocket 25, 26. The packs 20 are held in the pockets 25, 26 by means of an outwardly arranged, transversely directed protrusion, that is to say a lug 49.

Figure 3:
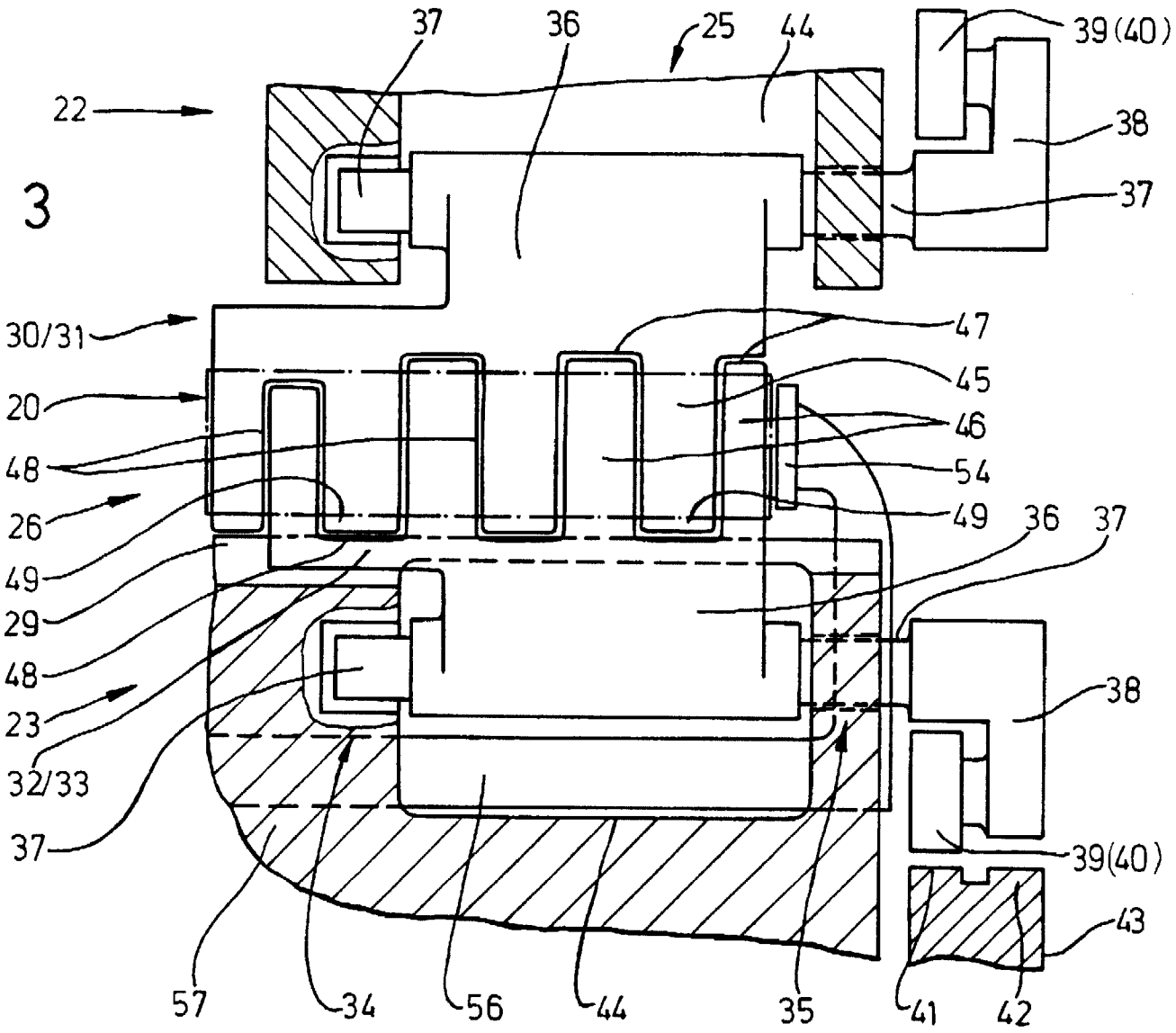
FIG. 3 shows a detail of FIG. 2 on a scale which is enlarged further still, but with a pocket of a transfer turret.
Figure 8:
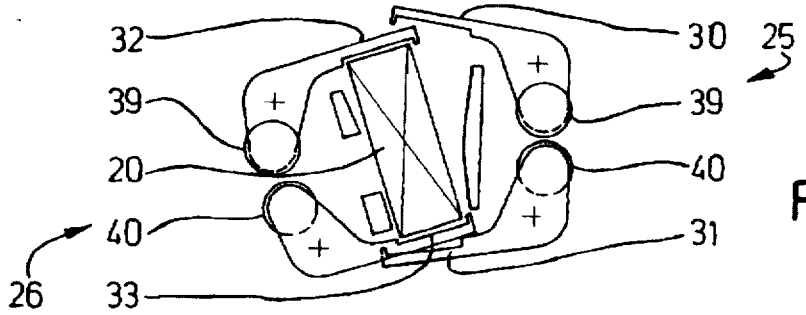
FIGS. 4–8 show side views of a number of phases during the transfer of a pack from the pocket of a turret to a pocket of a neighbouring turret.

The procedure of transferring a pack 20 by the transfer turret 22, and the receiving of the same by the drying turret 23, is shown in a number of phases in FIGS. 4 to 8. FIG. 3 shows, in side view, a central position of the pockets 25 and 26, corresponding to FIG. 6 of the movement phase.

Figure 4:
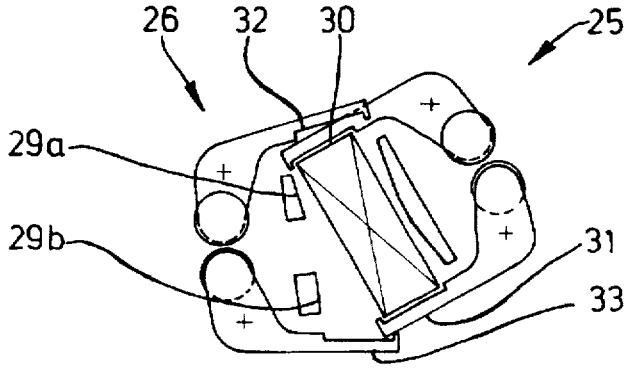

The incoming pocket 25 of the transfer turret 22 is initially closed (FIG. 4). The pack 20 is gripped by the pocket walls 30 and 31 in the region of narrow, elongate side surfaces 50. The pocket 26, assigned to said pocket 25, of the drying turret 23 is located in an open position, that is to say with spread-apart pocket walls 32, 33. Owing to the kinematics due to the movement along a circular path, the closed pocket 25, together with pack, can pass into the region between the pocket walls 32, 33.

Figure 7:
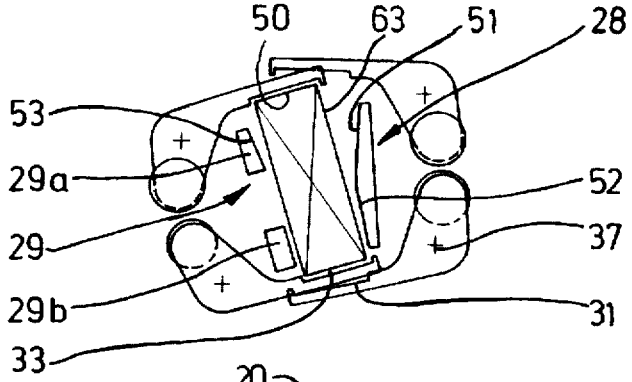
Figure 6:
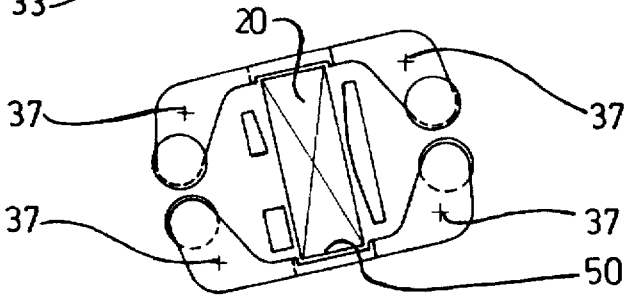

In the case of further movement of the pockets 25, 26 together in the same direction, the pocket 26 of the drying turret 23 gradually closes (FIG. 6). In a central, brief position of the two pockets within the transfer region 27, the pockets 25, 26 intersect exactly. The pockets lie coaxially. Each of the two pockets 25, 26 has a free inner space, the two inner spaces coinciding with one another. In practice, a common pocket inner space is enclosed by the pocket walls 30 . . . 33 of the two pockets 25, 26 (FIG. 6). In this arrangement, the pocket walls 30 . . . 33 interengage in the described manner owing to the comb-type shaping. In the subsequent movement phase, the pocket 25 of the transfer turret 22 gradually opens (FIG. 7). The pack 20 is then held by the pocket walls 32, 33 of the pocket 26. This pocket then moves more and more out of the region of the (open) pocket 25 until complete separation takes place owing to the circular movement path. The pack 20 is then located in the pocket 26. This transfer procedure occurs continuously without transversely directed movement of the packs 20.

The two pocket bases 28 and 29 are adapted to the illustrated movement progression. The pocket base 28 of the transfer turret 22 is designed in the form of a roof with two abutment surfaces 51, 52, arranged at an obtuse angle with respect to one another, for the pack 20 in the different movement phases. During transfer of the packs 20 from one turret to another turret, a relative oblique position with respect to the pocket base 28 or 29 is obtained. In the position according to FIG. 7, in the case of the present exemplary embodiment, the obliquely directed abutment surface 52 of the pocket base 28 comes into action. The other oblique abutment surface 51 acts in an analogous manner during the transfer of the pack 20 from the folding turret 21 to the transfer turret 22.

Figure 5:
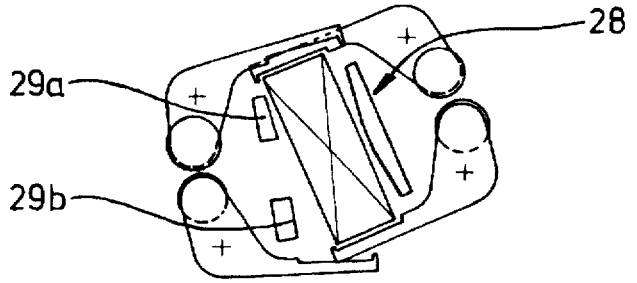

In the case of the pocket base 29 of the pocket 26, only one abutment surface 53 is designed obliquely. This comes into action in an initial phase the pack 20 is received (FIGS. 4 and 5).

Figure 9:
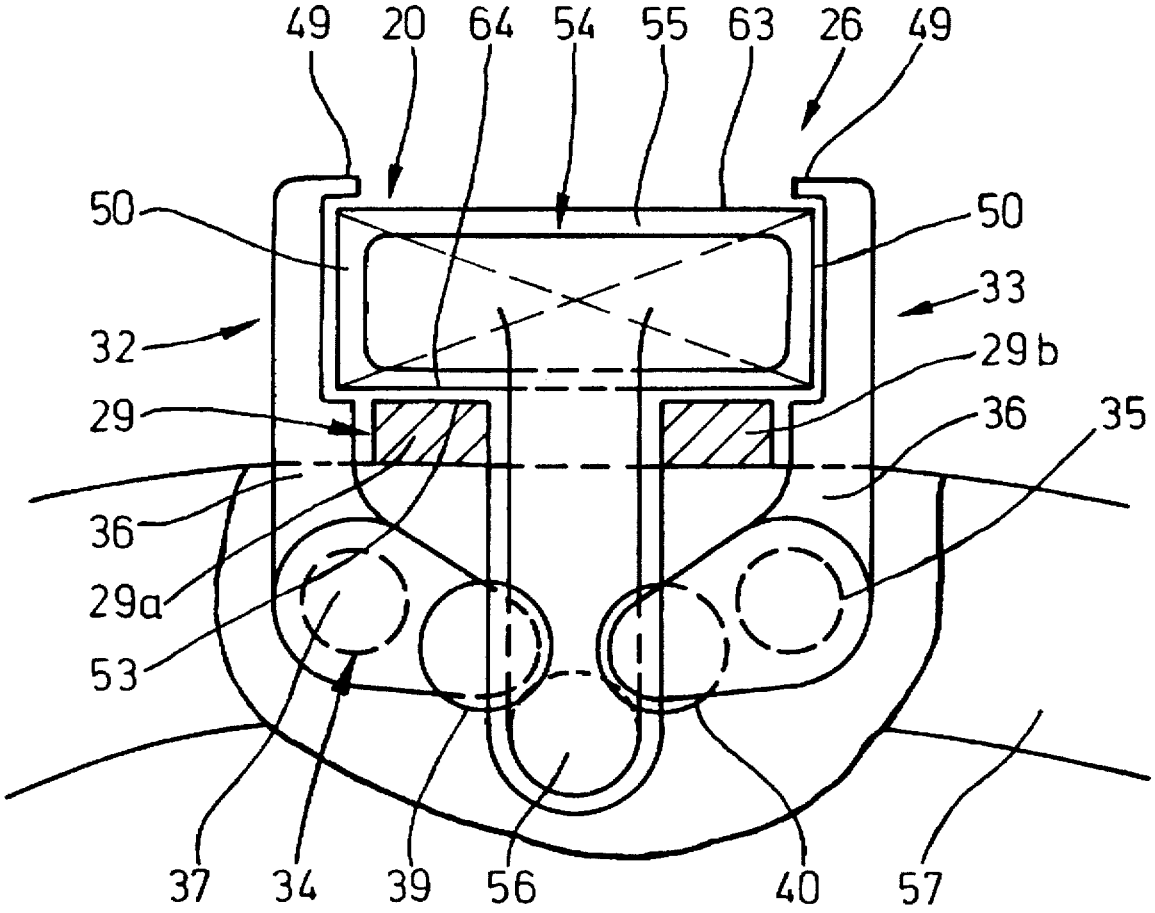
FIG. 9 shows an end view of a pocket of the turret (also view IX in FIG. 2)
Figure 10:
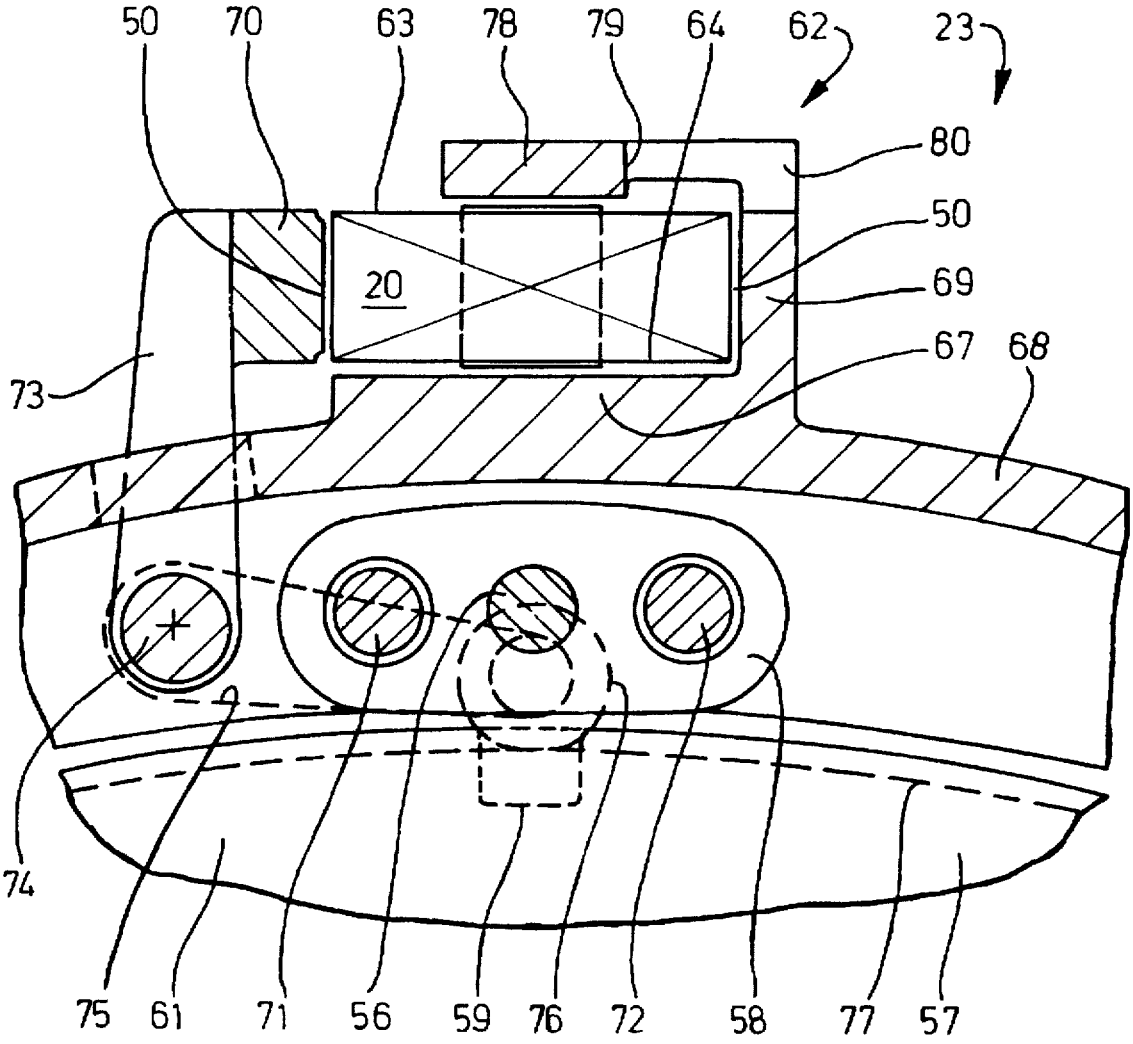
FIG. 10 shows a pack channel as part of the drying turret in cross-section (also detail section X—X in FIG. 2)

In the case of the present exemplary embodiment, the pocket base 29 of the pockets 26 of the drying turret 23 is divided approximately in the centre. This results in two spaced-apart sub-bases **29*a*, 29*b*. Of these, one sub-base 29*a*, located at the front in the direction of rotation, is provided with the oblique abutment surface 53. In the gap-like interspace between the sub-bases 29*a*, 29*b*, the slide 54 or a neck piece thereof can be moved back and forth (FIG. 9**).

Figure 2:
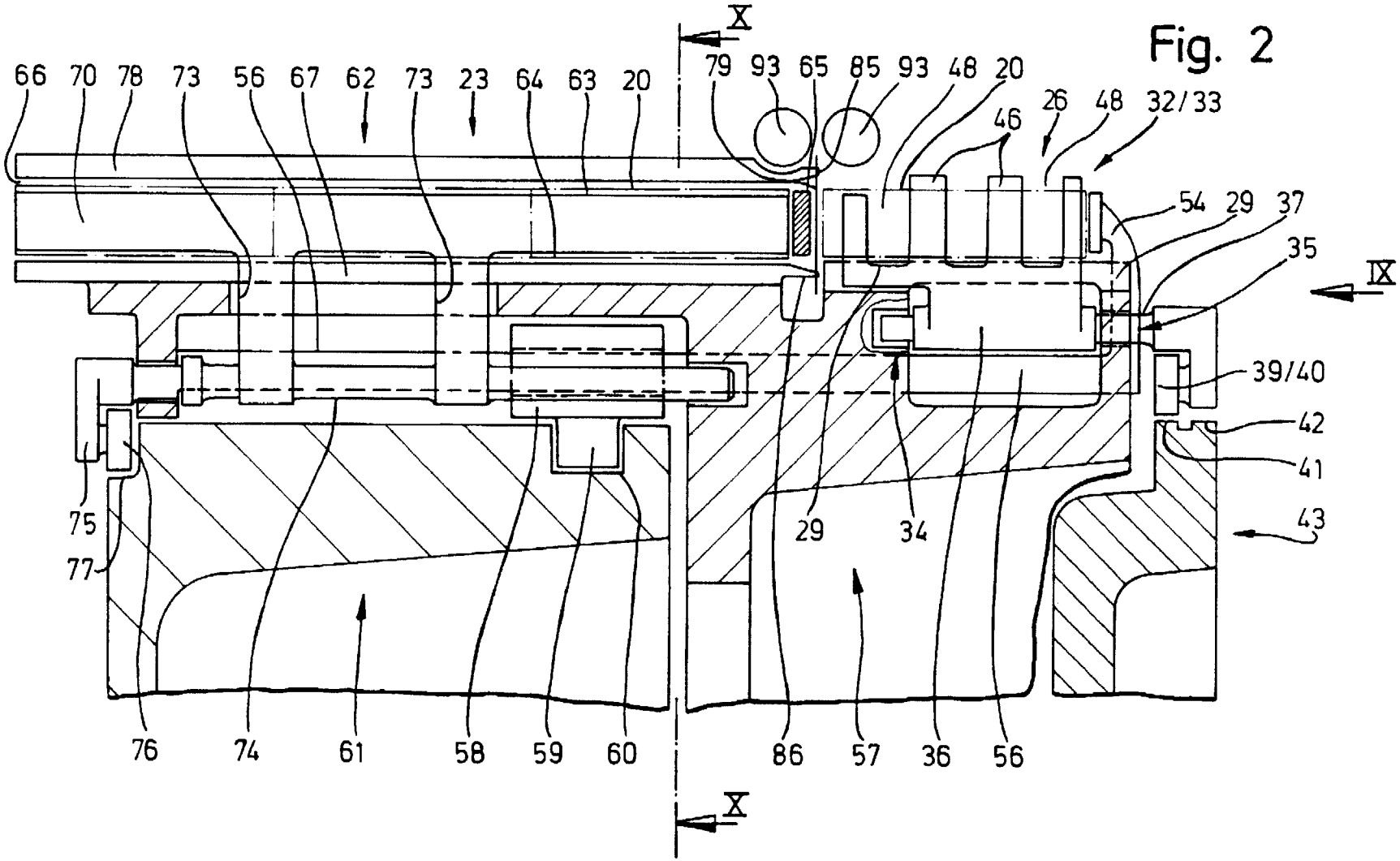
FIG. 2 shows, in radial section, a vastly enlarged detail of a turret, that is to say a drying turret.

The packs received by the pockets 26 of the drying turret 23 are gradually displaced, during the continuous rotational movement, in the axial direction of the drying turret 23. For this purpose, use is made of a slide 54 which grips the pack 20 on a rear end surface 55. The slide 54 is actuated by a slide rod 56 which is displaceably mounted in the body of the drying turret 23 or in a carrying part 57 thereof. The slide rod 56 can move back and forth in the axial direction, with the result that the slide 54 can be displaced out of the initial position, shown in FIGS. 2 and 3, in the direction of the opposite side of the drying turret 23, that is to say to the left in FIG. 2, in doing so taking along the pack 20. The latter is thereby displaced out of the (closed) pocket 26 and displaced into a special pack-receiving means of the drying turret 23.

The slide rod 56 is actuated via a carriage 58 which, by means of a pin 59, passes into a control groove 60 of a cylindrical control body 61. The control body 61 is mounted such that it is fixed. Owing to the special shape of the control groove 60, the coordinated back-and-forth movement of the slide rod 56, and thus of the slide 53, is effected. Said slide is displaceably mounted on two spaced-apart guide rods 71, 72.

The pack-receiving means of the drying turret 23 are, in the case of the exemplary embodiment shown, designed as elongate pack shafts 62. Each pack shaft 62 is dimensioned such that a plurality of packs 20 can be received one after the other in the longitudinal direction. The packs 20 are positioned within the pack shaft 62 such that end surfaces 50 of neighbouring packs butt against one another. The elongate side surfaces 50 of the packs point in the radial direction of the turret. Front side 63 and rear side 64 point outwards and radially inwards, respectively. In the present case, the length of a pack shaft 62 is dimensioned such that precisely three packs 20 can be received one after the other in a pack shaft 62.

During the continuous rotation of the drying turret 23, the packs 20 are displaced out of a pocket 26 by the slide 54 assigned to each pocket 26 and are displaced, via an inlet opening 65, into the pack shaft 62 which is directly adjacent or adjoins the pocket 26. A pack shaft 62 is accordingly assigned to each pocket 26. Pocket 26 and associated pack shaft 62 are aligned with one another during each movement phase, with the result that direct transfer can take place during the rotational movement.

By the displacement of a pack 20 into the shaft, a pack 20 is, by the same token, displaced, via an outlet opening 66, out of the pack shaft 62 by corresponding displacement of the packs 20 within the pack shaft 62, on the opposite side thereof. The pack shafts 62, which are arranged at small distances from one another along the circumference of the drying turret 23 and extend in an axis-parallel manner, are constructed in a particular way. A radially inwardly located wall, that is to say an inner wall 67 of each pack shaft 62, is part of a cylindrical casing 68 of the drying turret. Connected thereto is a side wall 69 which extends over the entire length of the pack shaft 62.

A corresponding side wall 70 is arranged opposite. This extends likewise over the length of the pack shaft 62, but can move relative to this, and thus relative to the packs 20. The side wall 70 can be raised from the packs and pressed onto them. On displacement of a pack 20 into the pack shaft 62, or displacement of the packs 20 within the pack shaft 62, the side wall 70 is raised slightly from the packs 20. After introduction of the pack 20, the side wall 70 acts as a press-on member for dimensionally stabilizing the packs 20.

In the case of the present example, the side wall 70 of the pack shafts 62 can be adjusted by pivoting. Each side wall 70 is mounted, by means of two retaining legs 73, on a rotational member, that is to say a rotational rod 74. The latter is driven such that it rotates back and forth in a suitable manner, in the present case via a pivot arm 75 which is arranged at one end of the rotational rod 74 and runs on a stationary camway 77 by means of a supporting roller 76. The shape of the camway 77 defines the movements of the side wall 70. The camway 77 is part of the fixed control body 61.

On the radially outwardly located side, the pack shaft 62 is delimited merely by a strip-shaped or web-shaped outer wall 78. This extends in the central region of the packs or of the outwardly directed front sides of the same. A revenue stamp 79 extending in the central region of the end surface 55 is located in the region of the outer wall 78. The latter is connected only to the side wall 69 via struts 80.

Figure 11:
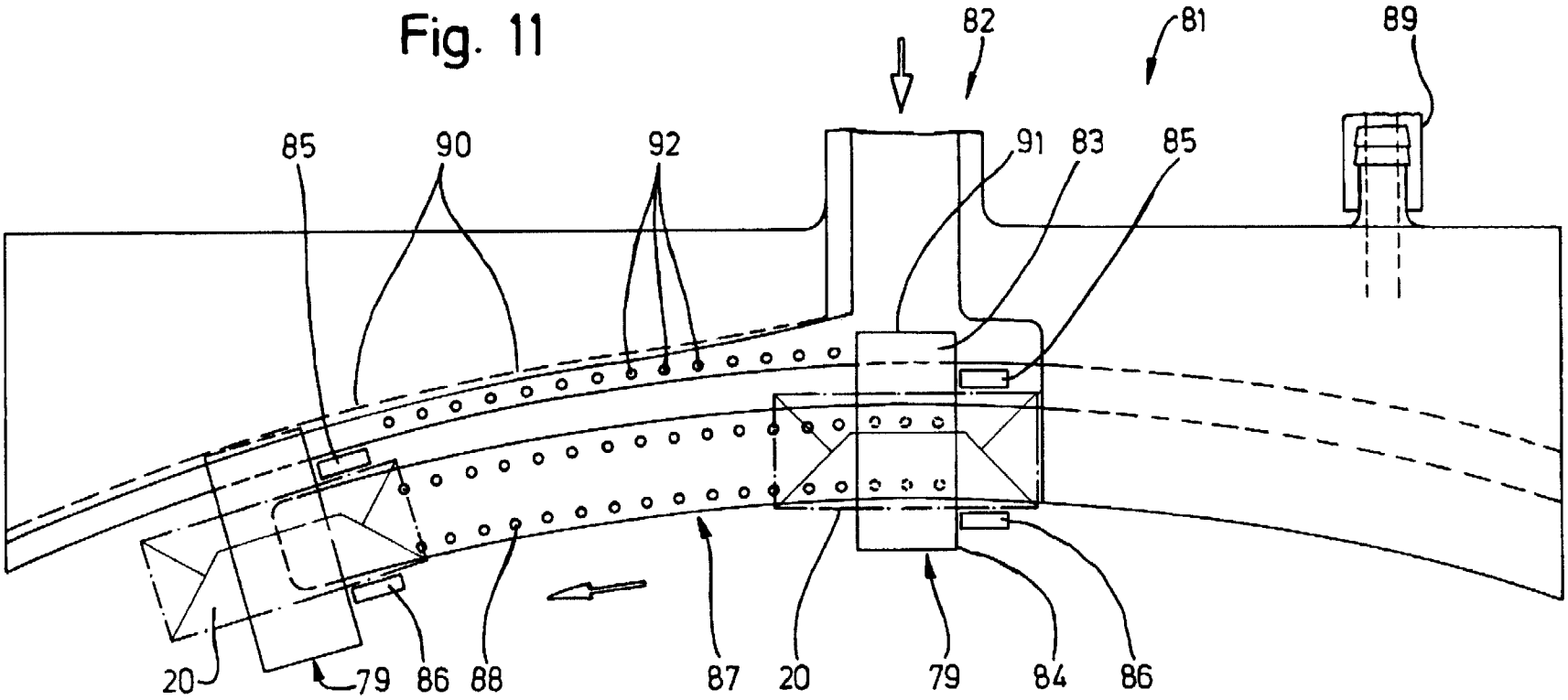
FIG. 11 shows, in elevation, a detail of the drying turret, that is to say the feed of a revenue step.
Figure 12:
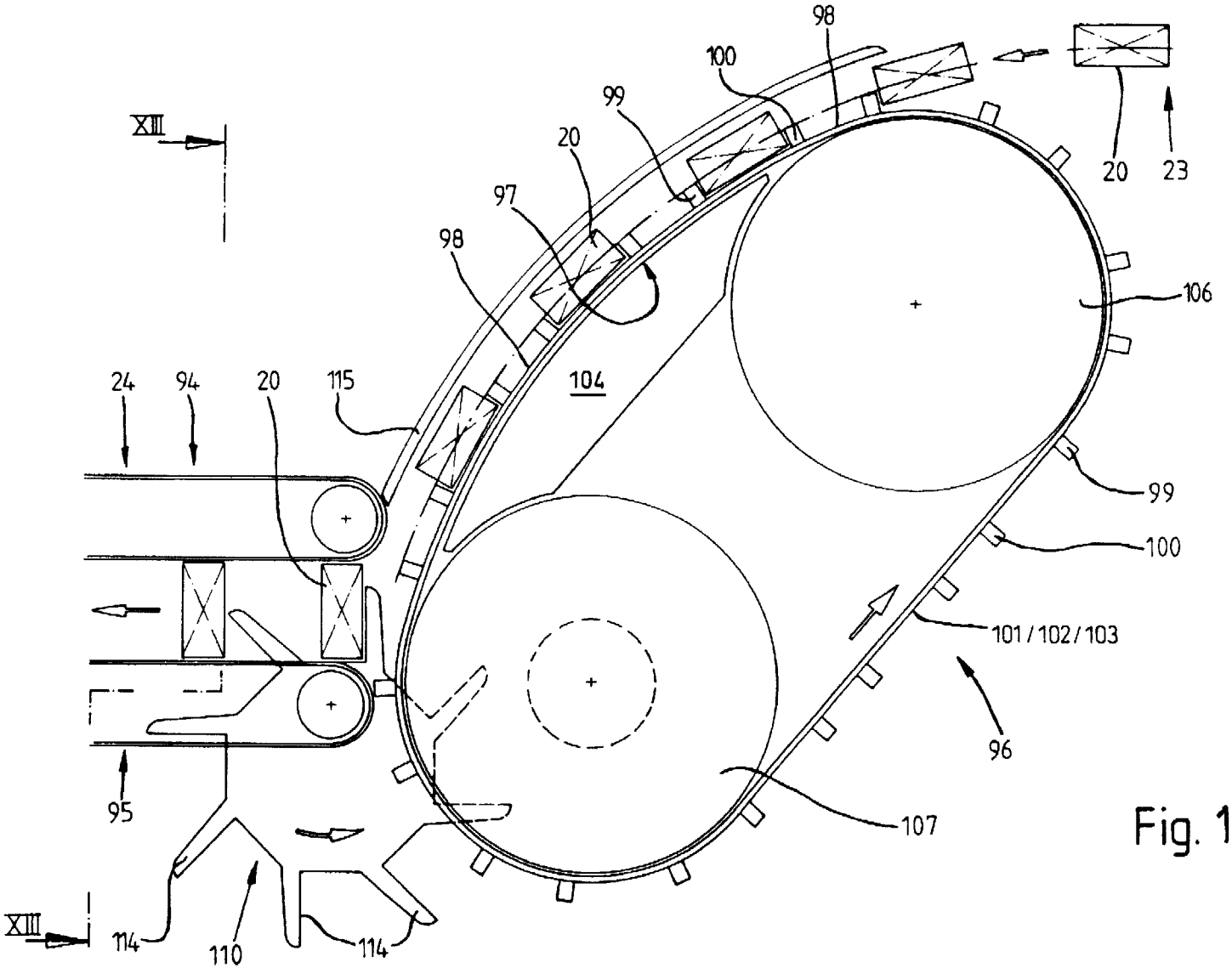
FIG. 12 shows, likewise in side view, conveying members for receiving and conveying away packs emerging from the drying turret.

The displacement of the packs 20 into the pack shafts 62 occurs in conjunction with the transfer of the revenue stamp 79 onto the end surface 55, which is located at the front in the direction of introduction, of the packs 20. The revenue stamps 79 are fed to the drying turret 23 in a top region of the drying turret 23 (FIG. 1) revolving in an upright plane. For this purpose, a fixed revenue-stamp supplying means 81 (FIG. 11) is arranged on the circumferential region of the drying turret 23. Said revenue-stamp supplying means extends over a top sub-region of the circular movement path of the pack shafts 62.

The revenue stamps are fed one after the other, via an upright revenue-stamp shaft 82, corresponding to the necessary relative position with respect to the end surface 55, to be precise from top to bottom or in the radial direction. The revenue stamps thereby pass into a position in front of the inlet opening 65 of a pack shaft 62. Each revenue stamp 79 is taken along by a revolving pack shaft 62, such that legs 83, 84 project beyond the inlet opening 65 of the pack shaft 62 at the top and bottom.

In this position, the revenue stamps 79 are gripped by drivers 85, 86 which are assigned to each pack shaft 62 and revolve therewith. In the present case, the drivers 85, 86 are arranged on the inner wall 67 of the pack shaft 62 on the one hand, and on the outer wall 78 of the pack shaft 62, on the other hand.

During driving through the associated pack shaft 62, the revenue stamps 79 are aligned precisely with respect to the inlet opening 65 in order to be received by a pack 20. For this purpose, guide members for the revenue stamps 79 extend over a sub-region in the circumferential direction of the drying turret 23. These guide members are constituted, on the one hand, by a guide web 87 which extends in the form of an arc of a circle in the circumferential direction. The guide web 87 is connected to the revenue-stamp supplying means 81, but is free in the guide region of the revenue stamps 79, with the result that the drivers 85, 86 can move on both sides of the guide web 87. The guide web 87 lies centrally with respect to the inlet opening 65 of the pack shafts 62.

During conveying, the revenue stamps 79 slide along the guide web 87. They are held in a slipping manner, by means of suction bores 88, on a side surface of the guide web 87—opposite the inlet opening 65. In the case of the present exemplary embodiment, the guide web 87 is equipped with two rows of suction bores 88, which run, adjacent to the arcuate borders, at small distances from one another. The suction bores 88 are connected to a subatmospheric-pressure source via suction channels, not shown in detail, via a central suction line 89.

In order to position the revenue stamps 79 further, the revenue-stamp supply means 81 is equipped with a guide edge 90 which is likewise in the form of an arc of a circle. This is located on the radially outwardly located side with respect to the movement path of the revenue stamp 79. A radially outwardly located, narrow side edge 91 of the revenue stamp 79 slides along the guide edge 90. As a result, the revenue stamp 79 is aligned, in the radial direction, with respect to the pack shaft. Suction bores 92 are also arranged in rows in a sub-region of the guide edge 90. Said suction bores grip an outwardly located leg 83 of the revenue stamp 79 and hold it in a slipping manner during conveying.

The precisely aligned revenue stamps 79 are gripped by the end surface 55 of a pack 20 when the latter is displaced into the pack shaft 62. The legs 83 and 84 rest, in this arrangement, in the form of a U on the front side 63 and rear side 64 of the pack.

Two conveying rolls 93 are assigned to the revenue-stamp shaft 82 for conveying the revenue stamps.

A particular subject dealt with by the apparatus is that of conveying away the packs 20 after leaving the drying turret 23. The packs 20 are transferred to the removal conveyor 24 such that, in the region of the same, the packs 20 are conveyed in an upright position in which the end surfaces 55 are directed to the sides and the narrow, elongate side surfaces 50 are directed to the top and bottom. By means of these, the pack 20 rests, at the top and bottom, on conveying bands 94 and 95.

In order to receive the packs 20 after leaving the drying turret 23, use is made of a belt conveyor 96. This is arranged, along a downwardly directed conveying section, in a region above an (imaginary) horizontal central plane of the drying turret 23. One conveying strand 97 of the belt conveyor 96 runs beside the drying turret 23, adjacent to the outlet openings 66 of the pack shafts 62. The conveying strand 97 is adapted precisely to the contour, in the form of an arc of a circle, of the drying turret 23. The relative position is such that one bearing surface 98 of the belt conveyor 96 in the region of the conveying strand 97 is located precisely in the plane of the pack shafts 62, that is to say the inner wall 67 of the same. The packs 20 emerging gradually from the pack shafts 62 pass, without being offset, onto the bearing surface 98 of the belt conveyor 96. In the region of the conveying strand 97, said belt is driven at the same rate as the pack shafts 62.

The belt conveyor 96 is provided with securing means for the packs 20. Said securing means are radially directed drivers 99 and 100. A pack 20 is received between in each case two such drivers 99 and 100. The spacing, that is to say the positions of the drivers 99, 100 relative to one another, corresponds precisely to the distances between the pack shafts 62 following one after the other. The radial height of the drivers 99, 100 is selected such that they extend approximately to the central plane of a pack 20.

In the present case, the belt conveyor 96 comprises a plurality of, that is to say three, spaced-apart conveying belts 101, 102, 103. These belts convey the packs 20 together and are accordingly driven in the same direction. Each conveying belt 101, 102, 103 is accordingly provided with drivers 99, 100, extending in the same planes, in order to grip the packs 20 together on a rear side surface 50 of the same.

In the region of the conveying strand 97, the conveying belts 101, etc. run in guides which correspond to the contour of the drying turret 23. These guides are constituted by a rigid guide body 104 in the region between deflecting wheels 106, 107. The conveying belts 101, etc. rest, with the conveying strand 97 on an outer supporting surface of the guide body 104. The guide surface is configured in the form of an arc of a circle, corresponding to the drying turret 23. In this region, grooves are formed for each conveying belt 101, etc. Correspondingly, the deflecting wheels 106, 107 are designed with grooves 105 on their circumference. These are continued in the region of the guide body 104. The grooves 105 are slightly wider than the conveying belts 101, etc., with the result that the latter can slide in the grooves 105.

The top deflecting wheel 106, or the deflecting wheel 106 directed towards a region for the introduction of the packs 20, is arranged such that the belt conveyor 96, or the conveying belts 101, etc. thereof, are guided up, in an approximately tangential manner, to the movement path of the packs 20 in the region of the pack shafts 62. As a result, the packs 20 emerging from the pack shafts 62 can pass into the region of the belt conveyor 96 without being impaired by the drivers 86 which are respectively at the rear.

The bottom deflecting wheel is designed in a divided manner, and accordingly comprises individual wheel discs 108 for receiving and deflecting a conveying belt 101, etc. in each case. An intermediate conveyor 110 passes into cavities 109 formed between the wheel discs 108. Said intermediate conveyor raises the packs 20 from the belt conveyor 96 and guides them into the region of the removal conveyor 24 such that the packs 20 assume the illustrated relative position between the conveying bands 94, 95.

For this purpose, the intermediate conveyor 110 is designed as a revolving conveying wheel, in the present case with two spaced-apart conveying wheels 111, 112. The two conveying wheels are arranged on a common shaft 113. The revolving conveying wheels 111, 112 are provided with radially projecting or approximately radially projecting driver fingers 114. A plurality of such driver fingers 114 are distributed along the circumference of the conveying wheels 111, 112 at regular intervals. The position of the driver fingers 114, that is to say a slight deviation from the radial direction, is selected such that, on transfer of a pack 20 to the removal conveyor 24, the respective driver finger 114 lies in an upright position, that is to say in a position which is transverse to the conveying direction. The driver fingers 114 of the conveying wheels 111, 112 are arranged in the same planes, with the result that they grip a pack 20 together.

The intermediate conveyor 110, or the shaft 113 thereof, is mounted such that the driver fingers 114 pass through the cavities 109 of the deflecting wheel 107 from the bottom and, with anti-clockwise rotation, remove the packs one after the other from the belt conveyor 96 and transfer them to the removal conveyor 24 after a very short conveying section. The angular position of the conveying belts 101, etc. when receiving the packs 20 by the driver fingers 114 corresponds approximately to the relative position of said packs when they are received.

Figure 13:
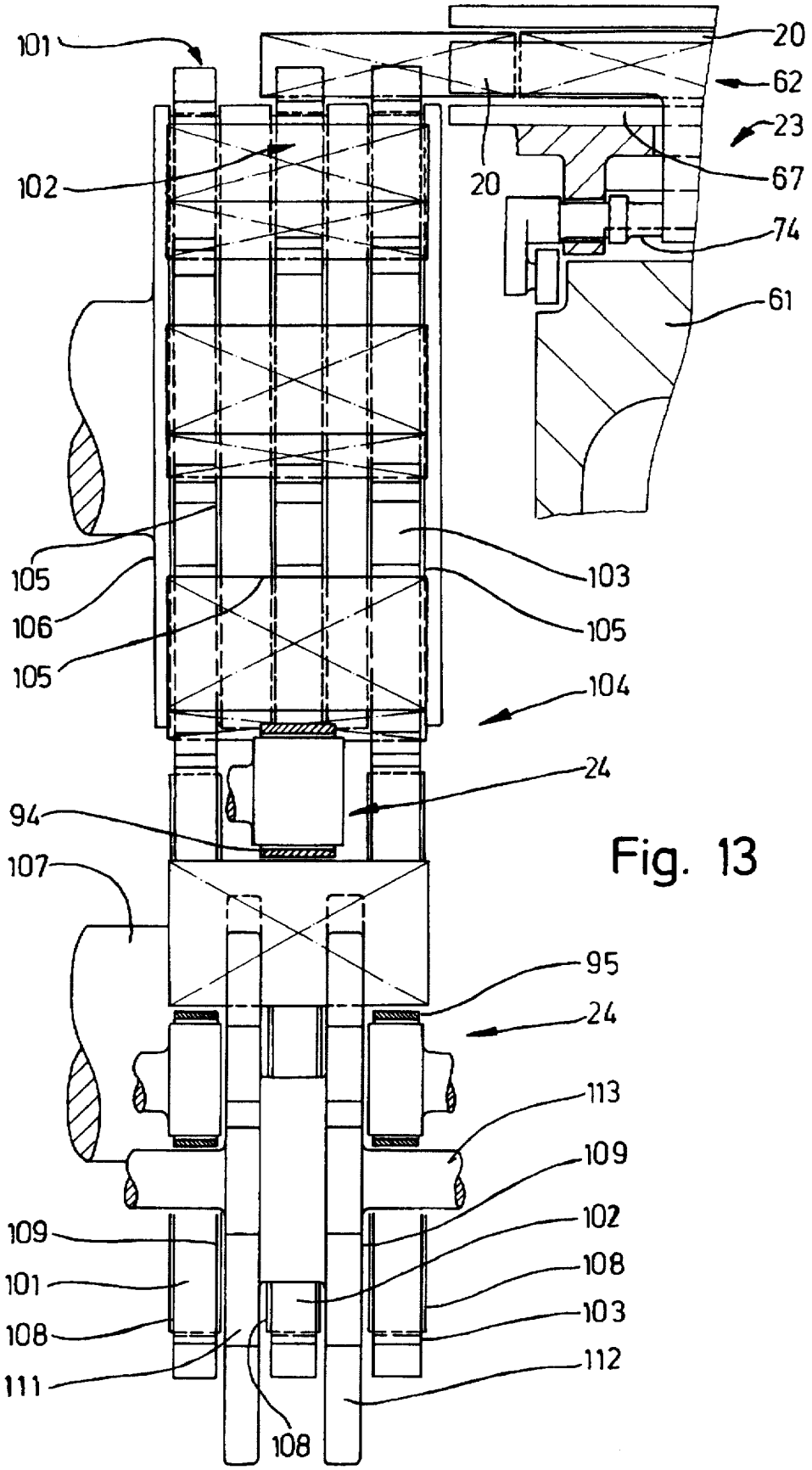
FIG. 13 shows a representation from FIG. 12 in the section plane XIII—XIII.

Since the intermediate conveyor 110 partially extends in the region of the removal conveyor 24, the bottom conveying band 25 of the latter is designed in a divided manner, and accordingly comprises two spaced-apart individual bands which run in the same direction and between which the intermediate conveyor 110, or the driver fingers 114 thereof, can revolve (FIG. 13).

A fixed outer guide 115 assigned to the conveying region of the belt conveyor 96 ends directly in the region of the removal conveyor 24. The rotational movement of the intermediate conveyor 110 is adjusted to the conveying rate of the belt conveyor 96, with the result that the packs 20 can be gripped one after the other in a positionally accurate manner.

What is claimed is:

1. An apparatus for producing cuboidal cigarette packs which are held and transported during production in first pockets (26) of a first rotating turret (23) which rotates around an axis, and which are then transferred to a discharge conveyor (24), comprising:

a) downstream of the first turret (23) in a conveying direction, a belt conveyor (96) to which the packs (20) are transferred in the axial direction of the turret;

b) means for transferring the packs in said axial direction from said turret (23) to said belt conveyor (96);

c) wherein the belt conveyor (96), together with a conveying strand (97) thereof, extends along the arcuate path of movement of the first turret (23); and d) an intermediate conveyor (110) for lifting the packs (20) off the belt conveyor (96) and transferring them to the discharge conveyor (24).

2. The apparatus as claimed in claim 1, further comprising means for placing the packs, emerging from the pockets of the turret (23), directly on the conveying strand (97) of the belt conveyor (96) without any offset.

3. The apparatus as claimed in claim 1, wherein the belt conveyor (96) comprises three rotating conveying belts (101, 102, 103) which are spaced apart from one another and rotate in the same relative position, and which have drivers (99, 100) for the packs (20), the conveying belts (101 to 103) extending in grooves (105) of a guide body (104) which is adapted to a contour of the turret (23).

4. The apparatus as claimed in claim 1, wherein the intermediate conveyor (110) is configured as a rotating conveyor wheel and provided with radially or approximately radially directed drive fingers (114) for gripping, in each case one pack (20) when removing it from the belt conveyor (96), and for said transferring to the discharge conveyor (24), the packs (20) being transferred into the discharge conveyor (24) when the driver fingers (114) are either in an upright position or in a position which is transverse relative to said conveying direction.

5. The apparatus as claimed in claim 4, wherein the belt conveyor (96) has a bottom deflecting wheel (107) comprising a plurality of spaced-apart wheel discs (108), the intermediate conveyor (110) being arranged with a sub-region between said wheel discs (108) of the belt conveyor (96).

6. The apparatus as claimed in claim 1, wherein the discharge conveyor (24) has a bottom conveying band (95) which comprises two individual belts which are spaced apart, the intermediate conveyor (110) being arranged with a sub-region between the individual belts of the conveyor band (95).

7. The apparatus as claimed in claim 1, wherein the packs (20), with end faces (55), elongate side faces (50), and a large-surfaced front side (63) or rear side (64), are arranged within the pockets in such a manner that front sides (63) and rear sides (64) are directed radially outwards or inwards, and wherein the packs (20) in the region of the discharge conveyor (24) are conveyed in an upright position in which the end faces (55) are directed sidewards and in which narrow, elongate side faces (50), at tops and bottoms of the packs, rest against the conveying band (94, 95) of the discharge conveyor.

8. The apparatus as claimed in claim 1, further comprising a second turret which is disposed axis-parallel to said first turret, which has second pockets for holding the packs, and which is upstream of said first turret, wherein the packs (20) held in the second pockets (25) are transferable from the second turret (22) to the axis-parallel adjacent first turret (23), and wherein the first and second pockets are provided with pocket walls (30, 31, 32, 33) for holding the packs (20), the pocket walls (30 to 33) being movable relative to one another for being opened and closed, and wherein the distances between the adjacent axis-parallel first and second turrets (22, 23) are dimensioned such that the respective paths of movement of the rotating first and second are pockets (25, 26) overlap one another in a transfer region (27) for the packs (20), and wherein the first and second pockets (25, 26) are configured such that they are movable past one another without contact in the region of transfer, and wherein the pocket walls (30 to 33), for transferring the packs (20) from the second turret to the first turret, are movable between an opened and a closed position such that the packs (20) are released by the second pockets (25) of the second turret and received by the first pockets (26) of the first turret (23).

9. The apparatus as claimed in claim 1, wherein said first turret (23) has elongate pack shafts (62) which coaxially adjoin the pockets (26) in the axial direction, each of said shafts for receiving a plurality of packs, such that the packs (20) can be pushed out of the pockets (26) into assigned ones of the pocket shafts (62) in the axis-parallel direction.

10. The apparatus as claimed in claim 9, wherein the pack shafts (62) are each provided with shaft walls, including an inner wall (67), two side walls (69, 70), and an outer wall (78), said shaft walls being assigned to surfaces of the packs (20), specifically side surfaces (50), a front surface (63) and a rear surface (64), at least one of said shaft walls (70) being pivotable.

11. The apparatus as claimed in claim 10, wherein the outer wall (78) of each pack shaft (62) is strip-shaped and extends in a central region of the pack shaft (62), the outer wall being connected to a fixed one (69) said two side walls via struts (80).

12. The apparatus as claimed in claim 9, wherein respectively in the region of an inlet opening (65) for the introduction of the packs (20) into each pack shaft (62) there is positioned a revenue stamp (79) transversely to the inlet opening (65), said revenue stamp (79), which is supplied in the radial direction from outside to a fixed revenue stamp supplying means (81), being held by a guide web (87) which is in the form of an arc of a circle and, in the region of the inlet opening (65), over a sub-section of the movement path of the pack shafts (62), holds the revenue stamp in a slipping manner by means of suction bores (88).

13. The apparatus as claimed in claim 1, wherein the path of movement of the pockets (26) the first turret (23) and the path of movement of the conveying band (95) extend next to one another over a sub-region of the conveying track and in the shape of an arc of a circle within the same.

14. An apparatus for producing cuboidal cigarette packs (20) which, during production, are conveyed in pockets (26) of a rotating turret (23) rotating in a path around an axis, and which subsequently are transferred in a conveying direction to a removal conveyor (24), wherein:

a) downstream of the turret (23) in the conveying direction, there is arranged a belt conveyor (96) to which the packs are transferred in the axial direction of the turret;

b) the belt conveyor (96) is offset relative to the turret (23) in said axial direction, and correspondingly extends in a plane parallel to a plane of said path of the turret (23), said path being an arc of a circle;

c) the belt conveyor (96) has a conveying strand (97) which extends along the path of the turret (23);

d) means are provided for transferring the packs (20) in said axial direction from said turret (23) to the conveying strand (97); and e) an intermediate conveyor (110) is provided for lifting the packs (20) off the belt conveyor (96) and transferring them to the removal conveyor (24).

15. The apparatus as claimed in claim 14, further comprising means for continuously driving the turret, the belt conveyor and the intermediate conveyor, so that the packs are continuously conveyed and transferred.

16. The apparatus as claimed in claim 15, wherein said intermediate conveyor (110) has driver fingers (114), and wherein the conveying strand (97) and the intermediate conveyor (110) have conveying paths which intersect one another so that the packs (20) are lifted off the conveying strand (97) and transferred to the removal conveyor (24) by said driver fingers (114).

17. The apparatus as claimed in claim 15, wherein the axis of the turret is horizontal, and wherein the conveying strand (97) runs along a downwardly extending track of the turret and rotates around another horizontal axis which is above an imaginary horizontal central plane of the turret.

* * * * *